US007692546B2

(12) United States Patent
Camp et al.

(10) Patent No.: US 7,692,546 B2
(45) Date of Patent: Apr. 6, 2010

(54) ANTENNA FOR A BACKSCATTER-BASED RFID TRANSPONDER

(75) Inventors: Michael Camp, Celle (DE); Martin Fischer, Pfedelbach (DE)

(73) Assignee: ATMEL Automotive GmbH, Heilbronn (DE)

( * ) Notice: Subject to any disclaimer, the term of this patent is extended or adjusted under 35 U.S.C. 154(b) by 540 days.

(21) Appl. No.: 11/698,148

(22) Filed: Jan. 26, 2007

(65) Prior Publication Data

US 2007/0171074 A1 Jul. 26, 2007

Related U.S. Application Data

(60) Provisional application No. 60/839,421, filed on Aug. 23, 2006.

(30) Foreign Application Priority Data

Jan. 26, 2006 (DE) ..... 10 2006 003 717

(51) Int. Cl.
*H01Q 1/36* (2006.01)
*H01Q 5/01* (2006.01)
*G08B 13/14* (2006.01)

(52) U.S. Cl. ..... 340/572.7; 340/572.2; 340/572.5; 343/895; 343/700 MS

(58) Field of Classification Search ..... 340/572.1, 340/572.5, 572.7, 572.2; 343/895, 700 MS
See application file for complete search history.

(56) References Cited

U.S. PATENT DOCUMENTS 5,241,923 A * 9/1993 Janning ..... 119/721
5,313,216 A 5/1994 Wang et al.
6,281,794 B1 * 8/2001 Duan et al. ..... 340/572.1
6,963,317 B2 * 11/2005 Zuk et al. ..... 343/895
7,460,083 B2 * 12/2008 Parsche et al. ..... 343/895
2004/0056823 A1 3/2004 Zuk et al.

FOREIGN PATENT DOCUMENTS

DE 103 93 263 T5 9/2005

OTHER PUBLICATIONS

Klaus Finkenzeller, "RFID Handbook," Fundamentals and Applications in Contactless Smart Cards and Identification, Second Edition, John Wiley & Sons Ltd.; section 4.2.6.2, pp. 133-141, 2003.
Thaysen et al., "A Logarithmic Spiral Antenna", Applied Microwave and wireless, J.F. White Publications, Feb. 2001, pp. 32.

* cited by examiner

*Primary Examiner*—Davetta W Goins
*Assistant Examiner*—Anne V Lai
(74) *Attorney, Agent, or Firm*—Muncy, Geissler, Olds & Lowe, PLLC

(57) ABSTRACT

An antenna is provided for a backscatter-based RFID transponder with an integrated receiving circuit, having a capacitive input impedance, for receiving a radio signal lying spectrally within an operating frequency range, whereby the antenna has two antenna arms, which extend outwardly in a spiral from a central area, in which the antenna arms can be connected to the integrated receiving circuit. According to the invention, each antenna arm has an arm length along the arm, which is selected so that one of the series resonance frequencies of the antenna is below the operating frequency range and the next higher parallel resonance frequency of the antenna is above the operating frequency range. The invention relates furthermore to a backscatter-based RFID transponder with an antenna of this type.

21 Claims, 3 Drawing Sheets

ANTENNA FOR A BACKSCATTER-BASED RFID TRANSPONDER

This nonprovisional application claims priority to Provisional Application No. 60/839,421, which was filed on Aug. 23, 2006, and to German Patent Application No. DE 102006003717, which was filed in Germany on Jan. 26, 2006, and which are all herein incorporated by reference.

BACKGROUND OF THE INVENTION

1. Field of the Invention

The present invention relates to an antenna for a backscatter-based RFID transponder (radio frequency identification) and a backscatter-based RFID transponder with an antenna of this type.

2. Description of the Background Art

The invention falls within the field of wireless and contactless communication. It falls in particular within the field of radio-based communication for the purpose of identifying articles, animals, persons, etc., and the transponders and remote sensors used for this purpose.

Although it can be used in principle in any contactless communication systems, the present invention and the problem on which it is based are explained below with reference to RFID communication systems and their applications. Here, RFID stands for radio frequency identification.

In RFID systems, data are transmitted bidirectionally with the use of high-frequency radio signals between a stationary or mobile base station, which is also often called a reading device, reader, or read/write device, and one or more transponders, which are attached to the articles, animals, or persons to be identified.

The transponder, which is also called a tag or label, typically has an antenna for receiving the radio signal emitted by the base station and an integrated circuit (IC) connected to the antenna. The integrated circuit in this regard comprises a receiving circuit for receiving and demodulating the radio signal and for detecting and processing the transmitted data. In addition, the integrated circuit has a memory for storing the data necessary for the identification of the appropriate article. Furthermore, the transponder may comprise a sensor, e.g., for temperature measurement, which, e.g., is also part of the integrated circuit. Such transponders are also called remote sensors.

RFID transponders may be used advantageously wherever automatic labeling, identification, interrogation, or monitoring is to occur. Articles such as, e.g., containers, pallets, vehicles, machines, luggage, but also animals or persons can be labeled individually with such transponders and identified without contact and without a line-of-sight connection. In the case of remotes sensors, in addition, physical properties or sizes can be determined and queried.

In the field of logistics, containers, palettes, and the like can be identified to determine the actual whereabouts, for example, during their transport. In the case of remote sensors, e.g., the temperature of the transported products or goods can be routinely measured and stored and read at a later time. In the field of protection from piracy, articles, such as, e.g., integrated circuits, can be provided with a transponder in order to protect unauthorized copies. In the commercial sector, RFID transponders can in many cases replace the bar code applied to products. There are additional applications, e.g., in the field of motor vehicles in antitheft devices or systems for monitoring air pressure in tires and in systems for access control for people.

Passive transponders do not have their own energy supply and obtain the energy necessary for their operation from the electromagnetic field emitted by the base station. Semi-passive transponders do have their own energy supply, but do not use the energy provided by it to transmit/receive data but, for example, to operate a sensor.

RFID systems with passive and/or semi-passive transponders, whose maximum distance from the base station is considerably greater than a meter, are operated within frequency ranges which are especially in the UHF or microwave range.

In such passive/semi-passive RFID systems with a relatively broad range, a backscattering method (backscattering) is generally used for data transmission from a transponder to a base station, during which a portion of the energy arriving at the transponder from the base station is reflected (backscattered). In this case, the carrier signal emitted by the base station is modulated in the integrated circuit of the transponder according to the data to be transmitted to the base station and reflected by means of the transponder antenna. Such transponders are called backscatter-based transponders.

In order to achieve the greatest range possible in backscatter-based transponders, it is necessary to supply as high a proportion as possible of the energy arriving from the base station at the transponder to the integrated receiving circuit of the transponder. Power losses of any type are to be minimized in this case. For this purpose, on the one hand, transponder antennas with a relatively broad receiving frequency range are required. Such relatively broadband antennas, in addition, can offer the advantage of fulfilling the requirements of several national or regional regulatory agencies with only one type of antenna. On the other hand, the energy picked up from the transponder antenna is to be supplied as undiminished as possible to the integrated receiving circuit, which typically has a capacitive input impedance, i.e., an impedance with a negative imaginary part.

German Patent Application DE 103 93 263 T5 discloses an antenna for an RFID system, which has a planar spiral structure with two arms. Proceeding from a central area, the two arms extend each in a spiral outwardly in a full turn. The input impedance of this antenna is also capacitive.

A disadvantage here is that the impedance of this antenna deviates greatly from the conjugate complex value of the impedance of the chip input circuit and, for this reason, an additional, separate matching circuit with a coil and a capacitor is required between the antenna and chip. Because of parasitic resistances in these elements, there are power losses on the transponder side, which reduce the range in a deleterious way. Furthermore, the separate matching circuit limits the freedom in the placement of the chip and causes more complicated and therefore more cost-intensive implementations of the transponder.

SUMMARY OF THE INVENTION

It is therefore an object of the present invention to provide an antenna for a backscatter-based RFID transponder having an integrated receiving circuit (IC) for receiving a radio signal lying spectrally within an operating frequency range, said antenna that enables greater ranges and simpler implementations of the transponder and permits broadband reception of high-frequency radio signals. It is furthermore the object of the invention to provide a backscatter-based RFID transponder that is simple to realize and has a greater range in broadband reception of high-frequency radio signals.

In an embodiment, the antenna of the invention has two antenna arms, which extend outward in a spiral from a central area, in which the antenna arms can be connected to the integrated receiving circuit; in this regard, each antenna arm has an arm length along the arm that is selected so that one of the series resonance frequencies of the antenna is below the operating frequency range and the next higher parallel resonance frequency of the antenna is above the operating frequency range.

The RFID transponder of the invention can have an integrated receiving circuit with a capacitive input impedance and an antenna of the invention connected to the integrated receiving circuit.

A length of the antenna arms should be selected so that the desired operating frequency range is between one of the series resonance frequencies and the next higher (neighboring) parallel resonance frequency of the antenna. It is assured in this way that the antenna has inductive reactance values within the operating frequency range. This makes it possible to approximate the input impedance of the antenna within the operating frequency range to the conjugate complex values of the input impedance of the integrated receiving circuit in such a way that no separate matching circuit is necessary between the antenna and receiving circuit. Power losses on the transponder side are reduced in this way so that high ranges result and a broadband reception of high-frequency radio signals is possible. In addition, simpler and more cost-effective implementations of the transponder are possible as a result.

In an embodiment of the antenna of the invention, the arm length is selected so that the antenna can have values of an inductive input impedance, which within the operating frequency range are approximated to the conjugate complex values of the capacitive input impedance in such a way that no circuit arrangement for impedance matching is necessary between the antenna and integrated receiving circuit. As a result, the IC can be placed directly in the central area of the antenna arms without constraints due to separate elements for impedance matching, so that especially simple and cost-effective but yet high-performance transponder realizations with broad ranges are made possible.

In an embodiment, the arm length is selected so that the series resonance frequency that results in the antenna having values of an inductive input impedance, which within the operating frequency range are approximated to the conjugate complex values of the capacitive input impedance in such a way that no circuit arrangement for impedance matching is necessary between the antenna and integrated receiving circuit, is below the operating frequency range. The frequency range that enables very good impedance matching and thereby very broad ranges without separate elements for impedance matching is advantageously selected from the frequency ranges in which the antenna has inductive reactance values, by appropriate specification of the arm length.

The series resonance frequency can correspond to the lowest series resonance frequency fs1 of the antenna—and thereby the parallel resonance frequency to the lowest parallel resonance frequency fp1 of the antenna. Therefore, by selecting the arm length in such a way that the desired operating frequency range is between the lowest series resonance frequency and the lowest parallel resonance frequency of the antenna, the antenna impedance can be matched advantageously also at relatively small effective resistances of the integrated receiving circuit to the conjugate complex values of the input impedance of the receiving circuit.

Each antenna arm can be made to describe at least one full turn, particularly at least 1.5 full turns around the central area. The antenna impedance can be matched advantageously very simply within the UHF frequency band in this way.

Each antenna arm can have an arm width transverse to the arm which changes along the arm, the arm width preferably increasing proceeding outwardly from the central area. This advantageously enables a very broadband reception.

In another embodiment, each antenna arm forms an inner radial spiral and an outer radial spiral, these radial spirals preferably following a logarithmic function. Antennas of this type advantageously have especially low reflections.

In another embodiment, the antenna arms are made polygonal or straight piecewise. A better area utilization by the antenna can be achieved in this way in the case of a predefined square or rectangular area.

The antenna arms can be made planar and lie in a common plane. Preferably, each antenna arm comprises a thin conductive layer, which is formed on a substrate. As a result, the antenna can be implemented in an especially simple way.

In an embodiment of the RFID transponder of the invention, the integrated receiving circuit is disposed in the central area of the antenna arms. This enables a very simple implementation of the transponder.

In another embodiment, each antenna arm comprises a thin conductive layer, which is formed on a substrate, and the integrated receiving circuit is formed on the substrate. This enables an especially simple implementation of the transponder.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
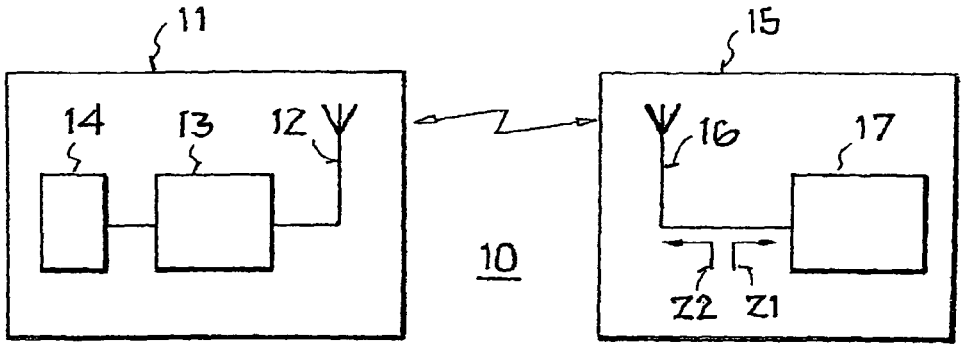
FIG. 1 shows an RFID system with a transponder according to an embodiment of the invention.

FIG. 1 shows schematically an example of an RFID system. RFID system 10 has a base station 11 and at least one transponder 15 of the invention. With the aid of high-frequency radio signals, the base station 11 exchanges data with transponder(s) 15 in a contactless and bidirectional manner.

Base station 11 has at least one antenna 12 for transmitting and receiving radio signals within an operating frequency range fB, a transmitting/receiving unit 13 connected to the antenna(s) for transmitting and receiving data, and a control unit 14 connected to the transmitting/receiving unit for controlling the transmitting/receiving unit 13.

The backscatter-based, passive, or semi-passive transponder 15 has an antenna 16 for receiving the radio signal, lying spectrally within the operating frequency range fB, and a receiving circuit 17, connected to the antenna, for demodulating the received radio signal and for detecting the data contained therein. Receiving circuit 17 is hereby part of an integrated circuit (IC), not shown in FIG. 1, e.g., an ASIC (application specific integrated circuit) or an ASSP (application specific standard product), which in addition normally has a memory for storing the data necessary for identification of the corresponding articles. Optionally, transponder 15 or the integrated circuit includes other components, not shown in FIG. 1, such as, e.g., a sensor for temperature determination. Such transponders are also called remote sensors.

It will be assumed below that the operating frequency range fB is within the UHF frequency band, namely, within a frequency range between about 840 MHz and about 960 MHz. Alternatively, the operating frequency range can also extend into the ISM Band (industrial, scientific, medical), available virtually worldwide, between 2.4 and 2.5 GHz. Other alternative operating frequency ranges are 315 MHz, 433 MHz, and/or 5.8 GHz.

Because of the different current requirements of regulatory agencies in regard to maximum permissible transmitting powers within the frequency range between 840 and 960 MHz, ranges of about 5 m in the read mode for the European market (500 mW ERP) and about 11 m for the USA (4 W EIRP) are aimed for.

Integrated receiving circuit 17 has a complex-valued input impedance Z1 with a real part (effective resistance) R1 and an imaginary part (reactance) X1. The effective resistance R1 in this case is preferably relatively small to minimize power losses. Because integrated inductors would take up relatively large chip areas, the reactance X1 is normally capacitive (X1<0) and, particularly at small values of the effective resistance R1, greater amount-wise than the effective resistance: |X1|>|R1|.

Integrated receiving circuits 17, developed by the applicant, have input impedances Z1 with effective resistances R1 in the range of about 4 . . . 35 ohm and capacitive reactances X1, whose absolute values are above about 150 ohm. The contribution of the imaginary part (|X1|) thereby greatly exceeds the real part (R1) (|X1|>4*R1). With the progressive manufacturing technology of integrated circuits and thereby declining structural sizes, capacitive reactances X1, which continue to increase amount-wise, can be assumed.

Antenna 16 of transponder 15 according to the invention comprises two antenna arms, which extend outwardly in a spiral from a central area, in which the antenna arms can be connected to integrated receiving circuit 17. The input impedance of antenna 16 is designated below with Z2=R2+j*X2, where R2 indicates the effective resistance and X2 the reactance of the antenna. Exemplary embodiments of the antenna of the invention are described below with reference to FIGS. 3 and 4.

Figure 2:
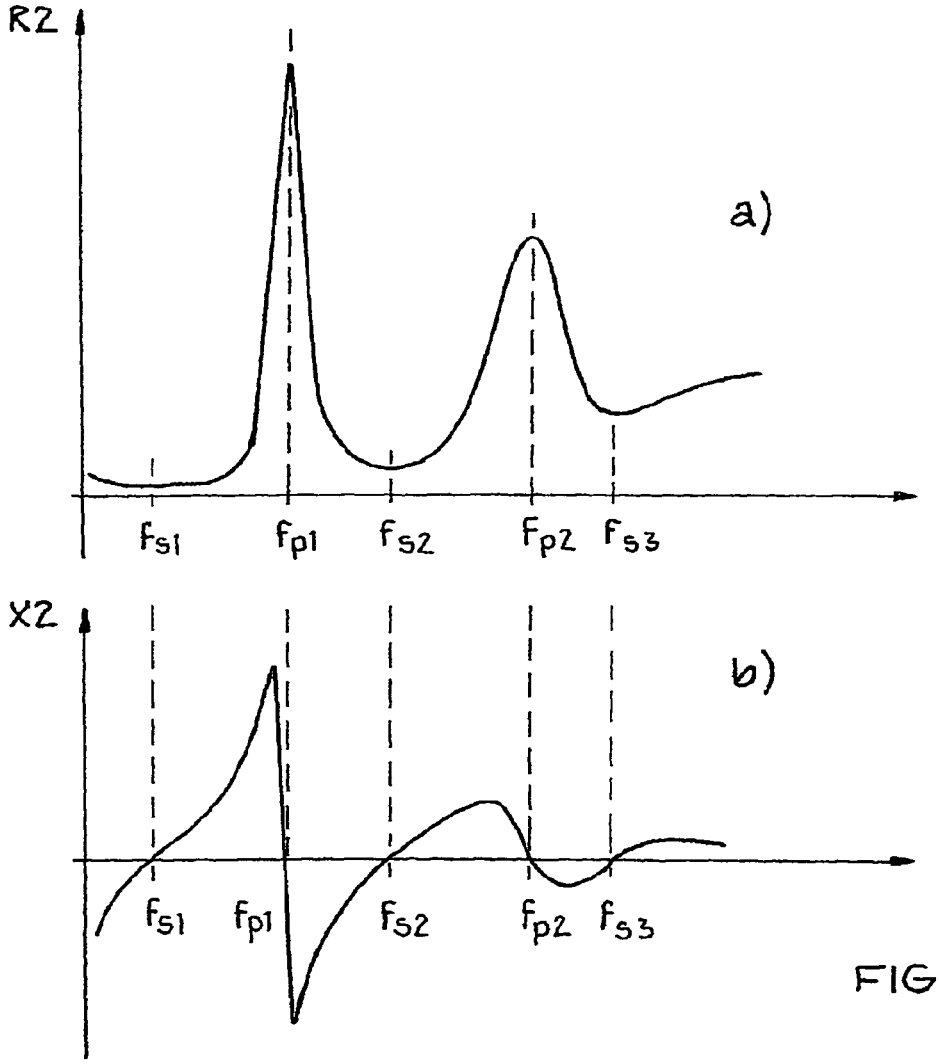
FIG. 2*a-b* illustrate a frequency response of the input impedance of an antenna with two spiral-shaped arms.

FIG. 2 schematically shows the frequency response of the input impedance Z2 of an antenna with two spiral-shaped arms. The frequency response of input impedance Z2 is shown here over a frequency range that is much broader than the previously mentioned range between about 840 and 960 MHz. The effective resistance R2, i.e., the real part of Z2, is plotted versus the frequency f in FIG. 2*a* and the reactance X2, i.e., the imaginary part of Z2, versus the frequency f in FIG. 2*b*.

It is evident from the curve shape of the imaginary part of Z2, shown in FIG. 2*b*, that the reactance X2 of the antenna at low frequencies f is initially capacitive (X2<0), but becomes inductive (X2>0) with an increasing frequency after passing through zero at the frequency f=fs1. After a highly inductive maximum value is exceeded, there is a steep decline during which clearly capacitive reactances again occur after again passing through zero at the frequency f=fp1. This sequence of transitions with a first, relatively slow transition from capacitive to inductive reactances, followed by a second, rapid transition from inductive to capacitive reactances, repeats qualitatively at higher frequency values as well.

The frequencies at which the reactance disappears (X2=0) are called resonance frequencies. Zero passages with a positive slope, i.e., transitions from capacitive to inductive reactances, are here designated as series resonance frequencies fs1, fs2, fs3, . . . , zero passages with a negative slope, i.e., transitions from inductive to capacitive values, however, as so-called parallel resonance frequencies fp1, fp2, . . . . The lowest series resonance frequency is also called the "first" series resonance frequency fs1 and the lowest parallel resonance frequency, the "first" parallel resonance frequency fp1.

It is evident from the curve shape of the real part of Z2, shown in FIG. 2*a*, that the effective resistance R2 of the antenna at lower frequencies f is initially slightly pronounced, then with increasing frequency rises first slowly and then rapidly to a maximum value and declines from this value at first greatly and then slightly to a minimum value. This wave- or U-shaped course of the effective resistance R2 versus the frequency f is repeated qualitatively at higher frequencies values. As is evident from FIG. 2*a*, the maximum values of the effective resistance R2 occur at the parallel resonance frequencies fp1, fp2, fp3, . . . , and the minimum values at the series resonance frequencies fs1, fs2, . . .

The invention is based on the idea of extending or compressing the curves, shown in FIG. 2, of the effective resistance and reactance of the antenna in the horizontal direction, i.e., in the direction of the frequency axis, by varying the (path) length L of the two spiral-shaped antenna arms. The longer the antenna arms are selected in this case, the more compressed the curves become toward the ordinate. The shorter the antenna arms are selected, the more the curves are stretched to the right, i.e., toward higher frequency values. The variation of the arm length L occurs in this case advantageously not (only) in integer multiples of complete (360 degree) turns of the arms around the central area, but continuously or in steps with small increments.

This affords the possibility by suitable selection (establishment) of the arm length L to match the input impedance Z2 of antenna 16 (FIG. 1) in the desired operating frequency range to the conjugate complex values of the input impedance Z1 of receiving circuit 17 and thus to achieve a complete, but at least partial impedance matching without separate components.

According to the invention, the arm length L is selected so that one of the series resonance frequencies fs1, fs2, fs3, . . . of the antenna is below the operating frequency range fB and the next higher frequency of the parallel resonance frequencies fp1, fp2, . . . of the antenna above the operating frequency range. The "next higher" parallel resonance frequency in this case means the lowest of the parallel resonance frequencies that are greater than the series resonance frequency lying below the operating frequency range. By therefore selecting the arm length L in such a way that the desired operating frequency range fB lies between a series resonance frequency fsk with k=1, 2, 3, . . . and the next higher parallel resonance frequency fpk (with the same value of the index k), according to FIG. 2*b*, it is ensured that the antenna has inductive reactance values X2>0 in the operating frequency range. Without separate components for impedance matching between antenna 16 and receiving circuit 17, as a result of the choice, according to the invention, of the arm length L, the input impedance Z2 of the antenna thereby approaches the conjugate complex value Z1'=R1−j*X1 of the capacitive input impedance Z1=R1+j*X1 (with X1<0) of the receiving circuit, so that power losses are reduced and therefore higher ranges result.

How close the inductive input impedance Z2 of the antenna can be brought to the likewise inductive impedance Z1' in this way depends on many, but particularly the following boundary conditions: a) the frequency-wise position and width of the desired operating frequency range fB, b) the value of the capacitive input impedance Z1 of the receiving circuit 17 and its course within the operating frequency range, and c) the precise form of the antenna of the invention (shape of the antenna arms, width of the arms, distances between the arms, realization of the antenna, etc.).

In an embodiment of the invention, the arm length L is selected so that the inductive input impedance Z2 of the antenna has values that within the operating frequency range fB are brought close to the impedance Z1' or coincide with Z1' in such a way that no separate circuit arrangement for impedance matching is necessary between antenna 16 and integrated receiving circuit 17. This is possible particularly at operating frequency ranges fB, which are much less broad than the differences fp1−fs1, fp2−fs2, etc., or with flat curves of Z1 and Z2 within the operating frequency range, but also at broader operating frequency ranges, provided the values of Z1 are not all too unfavorable (unfavorable values here are very high or extremely low effective resistances R1, and very high-reactances |X1|). Because in these cases no separate circuit arrangement for impedance matching is necessary, the IC can be placed advantageously directly in the central area of the antenna arms without constraints due to separate elements for impedance matching, so that especially simple and cost-effective but yet high-performance transponder realizations with broad ranges are made possible.

For example, among the boundary conditions explained heretofore with reference to FIG. 1, the length L of the two spiral-shaped antenna arms can be selected so that no separate circuit arrangement for impedance matching is necessary between antenna 16 and integrated receiving circuit 17, and nevertheless higher ranges and broadband reception can be achieved. Exemplary embodiments of antennas of the invention are described for this case below with reference to FIGS. 3 and 4.

Figure 3:
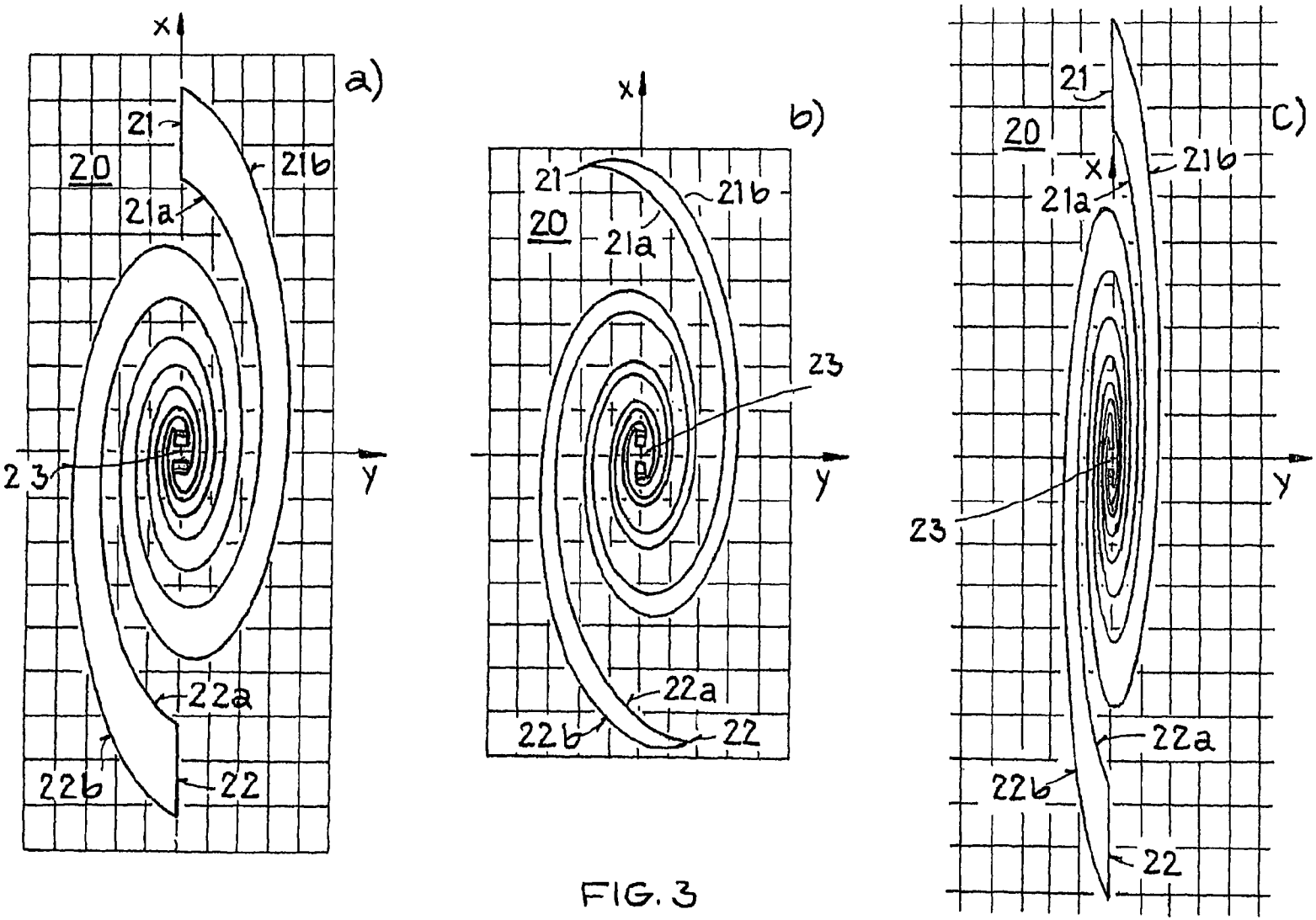
FIG. 3*a-c* illustrate three embodiments of an antenna of the invention.
Figure 4:
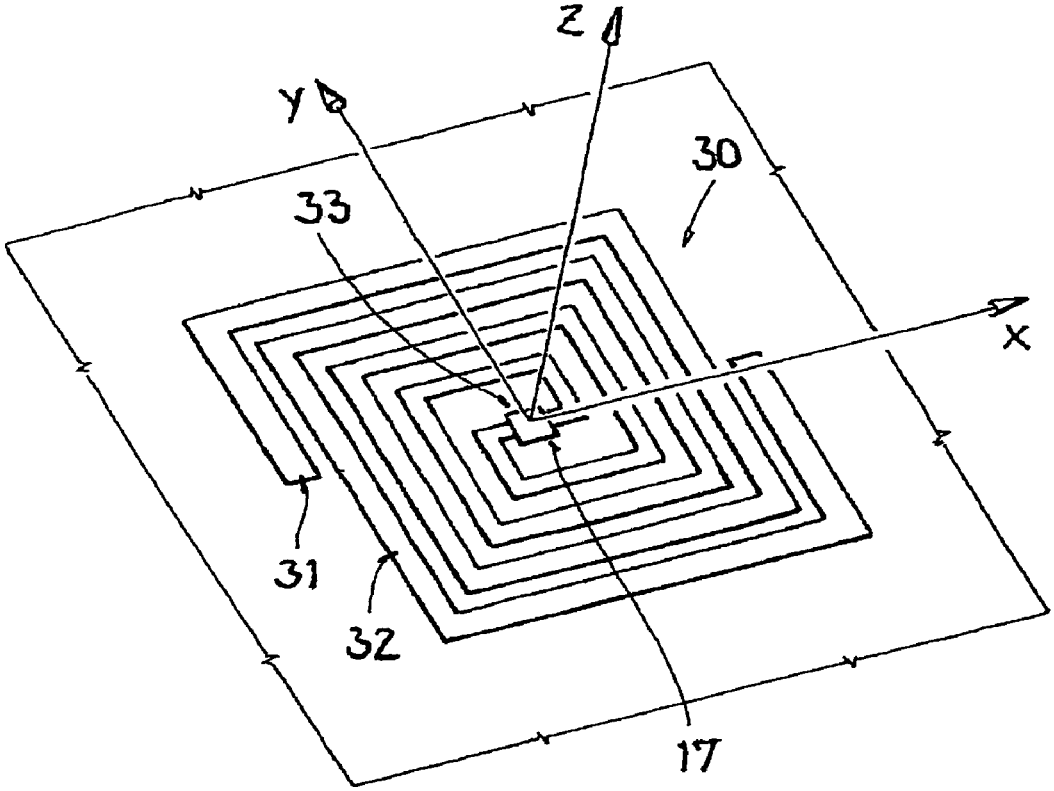
FIG. 4 illustrates a fourth exemplary embodiment of an antenna of the invention.

FIGS. 3 and 4 show embodiments of antennas of the invention for a backscatter-based RFID transponder according to the preceding description of FIG. 1.

All depicted exemplary embodiments are planar antennas whose arms in each case lie within a common plane.

The two antenna arms of each exemplary embodiment differ only in a rotation by 180 degrees. They are thereby made identically in their outer form.

Preferably, the two antenna arms each comprise a thin conductive layer, e.g., of copper, silver etc., which is formed on a common substrate, e.g., of polyimide or on a printed circuit board. Preferably, integrated receiving circuit 17 (FIG. 1) of the transponder, which is disposed advantageously in a central area of the respective antenna, is also formed on this substrate. Alternatively, it is possible to apply the thin conductive layer to a film on which the integrated receiving circuit is disposed by means of flip-chip technology. The transponder, consisting of an antenna and integrated receiving circuit, is finally attached to the article to be identified.

The arm length L in the depicted exemplary embodiments is selected each time so that the frequency range of about 840 MHz to about 960 MHz [text cut off] . . . lies . . . in each case the lowest series resonance frequency fs1 and in each case the lowest parallel resonance frequency fp1 of the antenna, which in each case results in antenna arms that describe essentially two full turns (360 degrees) around the central area.

To increase the broad bandwidth, all depicted exemplary embodiments have antenna arms whose arm width W transverse to the arm changes along the arm. This change in arm width can occur continuously along the arm or, however, abruptly in steps. Proceeding from the central area, the arm width W generally increases outwardly.

FIG. 3 each time in a top plan view shows a first, a second, and a third exemplary embodiment.

In these exemplary embodiments, each antenna 20 has two arms 21, 22, which are made identically except for a rotation by 180 degrees and extend spirally outwardly in oval spirals from a central area 23, whereby each arm describes substantially two rotations by 360 degrees in each case.

Each of the antenna arms 21 and 22 forms an internal radial spiral 21*a* or 22*a*, respectively, and an outer radial spiral 21*b* or 22*b*, respectively, which limit the second arm. The radial spirals 21*a*, 21*b*, 22*a*, 22*b* here follow a logarithmic function, which is why this type of antenna is also called a logarithmic spiral antenna.

Proceeding from central area 23, each antenna arm 21, 22 has an arm length L along the arm and an arm width W transverse to the arm, the arm length L as described above being selected according to the invention, and the arm width W changing continuously along the arm.

As is evident in FIG. 3 from the contact areas provided in the central antenna area 23, the antenna arms 21, 22 can be contacted at these contact areas directly by integrated receiving circuit 17 of transponder 15. Integrated receiving circuit 17 is disposed in central area 23 and preferably formed on the same substrate on which antenna arms 21, 22 are also formed. As a result, the implementation of the transponder is simplified advantageously.

The first exemplary embodiment shown in FIG. 3*a* has relatively broad antenna arms 21, 22, whose width generally increases proceeding from central area 23 outwardly. Along each arm, the width increases and decreases in sections in each turn, so that a "periodic" increase in width arises. Each arm hereby describes precisely two full 360-degree turns around central area 23. This antenna has a spread of about 8.3 cm in the x direction and of about 3.6 cm in the y direction.

Within the frequency range from about 840 MHz to about 960 MHz, the first exemplary embodiment has inductive input impedances Z2 with values of the effective resistance R2 between about 4 and about 37 ohm and values of the reactance X2 between about 160 and about 370 ohm. As a result, the input impedance Z2 is sufficiently matched to the conjugate complex values of the input impedance Z1 of receiving circuit 17 of transponder 15, which has been described above with reference to FIG. 1. A separate circuit arrangement for impedance matching is advantageously not necessary.

The second exemplary embodiment shown in FIG. 3*b* has relatively narrow antenna arms 21, 22, which are disposed at a relatively large distance relative to each other. The width of each arm increases proceeding from central area 23 in general again outwardly, whereas a "periodic increase" arises again along the arm. At the outer end of the arm, the width declines continuously. Each arm hereby describes about 2.1 full 360-degree turns around central area 23. This antenna has a spread of about 6.8 cm in the x direction and of about 3.3 cm in the y direction, so that the area occupied by the antenna is advantageously about 25% smaller than in the first exemplary embodiment.

Within the aforementioned frequency range, the second exemplary embodiment has inductive input impedances Z2 with values of the effective resistance R2 between about 4 and about 16 ohm and values of the reactance X2 between about 180 and about 370 ohm. A separate circuit arrangement for impedance matching is advantageously not necessary here either.

The third exemplary embodiment shown in FIG. 3*c* is characterized in comparison with first exemplary embodiment of FIG. 3*a* by a stretching in the direction of the x-axis and a compression in direction of the y-axis. The width of each arm again increases generally outwardly and increases and decreases periodically along the arm. Each arm describes precisely two full 360-degree turns around central area 23. This antenna has a spread of about 10 cm in the x direction and of about 1.6 cm in the y direction, so that this antenna is particularly suitable for manufacturing on a band and/or for applications in which a longish area is available for the antenna. The area occupied by this antenna is advantageously about 45% smaller than in the first exemplary embodiment.

Within the aforementioned frequency range, the third exemplary embodiment has inductive input impedances Z2 with values of the effective resistance R2 between about 4 and about 35 ohm and values of the reactance X2 between about 170 and about 400 ohm. A separate circuit arrangement for impedance matching is advantageously not necessary here as well.

Due to this low steepness of the curves for impedance versus frequency, the antennas shown in FIG. 3 have a high bandwidth. The bandwidth of the entire system (transponder) depends greatly on the impedance of the integrated receiving circuit, on the antenna substrate carrier, and on the background to which the transponder is attached. Tests by the applicant have produced bandwidths for the entire system of over 30 MHz.

Instead of the spiral antennas with oval spirals described with reference to FIG. 3, antennas with circular spirals can also be provided, if, e.g., a square or circular area is available for the antenna. In this case, the width of each arm increases proceeding from central area 23 continuously and monotonously along the arm—perhaps with the exception of a slowly tapering arm end analogous to FIG. 3*b*.

FIG. 4 in a perspective view shows a fourth exemplary embodiment of an antenna of the invention.

In this exemplary embodiment, antenna 30 has two arms 31, 32, which are made identically except for a rotation by 180 degrees and extend outwardly in a spiral in square spirals from a central area 33, each arm describing 2.25 rotations by 360 degrees in each case.

Each of antenna arms 31 and 32 here has several straight arm sections, which are disposed to one another at angles of 90 degrees in each case. This antenna type is also called a polygonal spiral antenna. In addition to right angles, other angles between the arm sections can also be provided, so that almost any number of corners per full turn of an arm can be realized. Furthermore, the spirals can also be made rectangular instead of square.

Proceeding from central area 33, each antenna arm 31, 32 has an: arm length L along the arm and an arm width W transverse to the arm. In this case, the arm length L as described above was selected according to the invention, and the arm width W changes along the arm.

The antenna arms 31, 32 are connected in central area 33 directly to integrated receiving circuit 17 of transponder 15. Integrated receiving circuit 17 is disposed in central area 33 and preferably formed on the same substrate on which the antenna arms are also formed. As a result, the implementation of the transponder is simplified.

The width W of the antenna arms preferably remains constant in each straight arm section but changes "abruptly" at the corners. Proceeding from central area 33, the first straight section can have a first width, the next straight section a second, greater width, and the third section a third, greater width (in turn in comparison to the second width), etc. Alternatively to a such piece-wise constant width along the antenna arms, the arm width of all or only certain antenna arms can increase linearly proceeding from the central area along the arm.

The antenna shown in FIG. 4 has an x/y spread of about 7 cm×7 cm. Within the aforementioned frequency range, the fourth exemplary embodiment has inductive input impedances Z2 with values of the effective resistance R2 between about 7 and about 30 ohm and values of the reactance X2 between about 100 and about 240 ohm. Depending on the location of the operating frequency range, a separate circuit arrangement is not necessary for impedance matching.

Although the present invention was described above with reference to exemplary embodiments, it is not limited thereto but can be modified in many ways. Thus, the invention, for example, is limited neither to passive or semi-passive transponders, nor to the indicated frequency bands, the indicated impedance values of the integrated receiving circuit, or the shown forms of the spirals of the antenna arms, etc. Rather, the invention can be used advantageously in highly diverse contactless communication systems.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An antenna for a backscatter-based RFID transponder comprising:

an integrated receiving circuit having a capacitive input impedance for receiving a radio signal lying spectrally within an operating frequency range; and two antenna arms that extend outwardly in a spiral from a central area in which the antenna arms are connected to the integrated receiving circuit, wherein said antenna arms together exhibit a plurality of resonance frequencies including a first plurality of series resonance frequencies when a reactance of said antenna arms passes from a capacitive reactance to an inductive reactance and a second plurality of parallel resonance frequencies when said reactance passes from an inductive reactance to a capacitive reactance, wherein each antenna arm has an arm length along the arm, which is selected so that one of the series resonance frequencies of the antenna is below the operating frequency range and the next higher parallel resonance frequency of the antenna is above the operating frequency range.

2. The antenna according to claim 1, wherein the arm length is selected so that the antenna has values of an inductive input impedance, which within the operating frequency range are approximated to conjugate complex values of the capacitive input impedance in such a way that no circuit arrangement for impedance matching is necessary between the antenna and integrated receiving circuit.

3. The antenna according to claim 1, wherein the arm length is selected so that the series resonance frequency that results in the antenna having values of an inductive impedance, which in the operating frequency range are approximated to the conjugate complex values of the capacitive input impedance in such a way that no circuit arrangement for impedance matching is necessary between the antenna and integrated receiving circuit, is below the operating frequency range.

4. The antenna according to claim 1, wherein the series resonance frequency corresponds to the lowest series resonance frequency of the antenna.

5. The antenna according to claim 1, wherein each antenna arm is formed to circumscribe at least one full turn or at least 1.5 full turns, around the central area.

6. The antenna according to claim 1, wherein each antenna arm has an arm width transverse to the arm, and wherein the arm width changes along the arm.

7. The antenna according to claim 6, wherein the arm width increases outwardly proceeding from the central area.

8. The antenna according to claim 1, wherein each antenna arm forms an inner radial spiral and an outer radial spiral.

9. The antenna according to claim 8, wherein the inner radial spiral and the outer radial spiral follow a logarithmic function.

10. The antenna according to claim 1, wherein the antenna arms are made polygonal or straight piece-wise.

11. The antenna according to claim 10, wherein the arm width along the arm is constant piece-wise.

12. The antenna according to claim 1, wherein the antenna arms are made identically in their outer form.

13. The antenna according to claim 1, wherein the antenna arms are made planar and lie in a common plane.

14. The antenna according to claim 1, wherein each antenna arm comprises a thin conductive layer, which is formed on a substrate.

15. The antenna according to claim 1, wherein the two antenna arms are formed on the integrated receiving circuit.

16. A backscatter-based RFID transponder comprising:

an integrated receiving circuit having a capacitive input impedance; and an antenna connected to the integrated receiving circuit, the antenna comprising:

two antenna arms that extend outwardly in a spiral from a central area in which the antenna arms are connected to the integrated receiving circuit, wherein said antenna arms together exhibit a plurality of resonance frequencies including a first Plurality of series resonance frequencies when a reactance of said antenna arms passes from a capacitive reactance to an inductive reactance and a second plurality of parallel resonance frequencies when said reactance passes from an inductive reactance to a capacitive reactance, and each antenna arm having an arm length along the arm, which is selected so that one of the series resonance frequencies of the antenna is below the operating frequency range and the next higher parallel resonance frequency of the antenna is above the operating frequency range.

17. The backscatter-based RFID transponder according to claim 16, wherein the integrated receiving circuit is disposed in the central area of the antenna arms.

18. The backscatter-based RFID transponder according to claim 16, wherein each antenna arm comprises a thin conductive layer, which is formed on a substrate, and wherein the integrated receiving circuit is formed on the substrate.

19. The backscatter-based RFID transponder according to claim 16, wherein the capacitive input impedance has an effective resistance and a reactance, a value of the reactance being higher amount-wise than a value of the effective resistance.

20. The backscatter-based RFID transponder according to claim 16, wherein the transponder is passive or semi-passive.

21. The backscatter-based RFID transponder according to claim 16, wherein the operating frequency range is within the UHF or microwave frequency range.

* * * * *